US011590381B2

(12) United States Patent
Hollins

(10) Patent No.: US 11,590,381 B2
(45) Date of Patent: Feb. 28, 2023

(54) SKILL TRAINING APPARATUS, METHODS OF USE AND MANUFACTURE

(71) Applicant: ITRAINFUNDAMENTALS, LLC, Germantown, TN (US)

(72) Inventor: Lionel Hollins, Germantown, TN (US)

(73) Assignee: iTrain Fundamentals LLC, Collierville, TN (US)

( * ) Notice: Subject to any disclaimer, the term of this patent is extended or adjusted under 35 U.S.C. 154(b) by 2 days.

(21) Appl. No.: 16/016,589

(22) Filed: Jun. 23, 2018

(65) Prior Publication Data

US 2019/0388725 A1 Dec. 26, 2019

Related U.S. Application Data

(60) Provisional application No. 62/524,158, filed on Jun. 23, 2017.

(51) Int. Cl.
*A63B 21/00* (2006.01)

(52) U.S. Cl.
CPC ..... *A63B 21/4015* (2015.10); *A63B 21/4034* (2015.10); *A63B 2208/0204* (2013.01); *A63B 2209/00* (2013.01); *A63B 2209/10* (2013.01)

(58) Field of Classification Search
CPC ..... A63B 21/4015; A63B 21/4034; A63B 2208/0204; A63B 2209/10; A63B 2209/00; A63B 2071/0063; A63B 71/0054; A63B 1/00; A63B 21/02–0557; A61H 2015/0014
See application file for complete search history.

(56) References Cited

U.S. PATENT DOCUMENTS 3,279,459 A 10/1966 Schenker
3,529,820 A * 9/1970 Templeton ..... A63B 21/0552 482/122
3,624,190 A 1/1971 Cekada, Jr.
4,489,937 A * 12/1984 Kong ..... A63B 21/00043 482/126
4,815,731 A * 3/1989 Suarez ..... A63B 21/055 482/124
5,205,803 A 4/1993 Zemitis
5,490,826 A * 2/1996 Rose ..... A63B 21/0004 482/124
5,643,149 A * 7/1997 Grimaldi ..... A63B 5/20 482/122
7,045,577 B2 5/2006 Wilkes et al.
(Continued)

*Primary Examiner* — Nyca T Nguyen
(74) *Attorney, Agent, or Firm* — Technology Legal Counsal LLC

(57) ABSTRACT

This technology relates generally methods of making and using systems designed to enhance athletic skill development and, more particularly, to methods of maintaining proper foot alignment for certain activities that require agility and consistency. There exists a need for a training device that not only allows a user to dynamically transition back-and-forth between a wider and narrower stance, but also protects the lower extremities of the user when in a narrower stance. In particular, during the process of bringing their legs together, the user's foot and ankle could be injured if the training device is not designed in such a way to ergonomically accommodate the ankle and/or have appropriate cushioning features to insulate the foot and/or ankle from full impact against blunt or sharp surfaces.

11 Claims, 9 Drawing Sheets

(56) References Cited

U.S. PATENT DOCUMENTS 7,344,485 B1 * 3/2008 Simpson ..... A63B 21/0004 482/121
7,674,925 B2 3/2010 Garrett
7,695,413 B1 * 4/2010 Cruz ..... A63B 21/05 482/126
7,786,239 B2 8/2010 Petrovic et al.
7,794,374 B1 9/2010 Park
7,893,287 B2 2/2011 Casper et al.
8,153,746 B2 4/2012 Petrovic et al.
8,556,784 B2 * 10/2013 Leibowitz ..... A63B 21/0023 482/121
8,961,377 B1 * 2/2015 Simplis ..... A63B 21/0552 482/124
9,168,411 B2 * 10/2015 Holman ..... A63B 21/028
2002/0022555 A1 * 2/2002 Nesci ..... A63B 21/0552 482/91
2008/0026863 A1 * 1/2008 Eck ..... A63B 69/3623 473/212
2008/0139369 A1 * 6/2008 Vigilia ..... A63B 21/4009 482/124
2009/0186722 A1 * 7/2009 Hohl, Jr. ..... A63B 69/0059 473/422
2012/0065557 A1 * 3/2012 Phillips ..... A63B 23/0222 601/99
2012/0100967 A1 * 4/2012 Leibowitz ..... A63B 21/0552 482/124
2012/0322633 A1 * 12/2012 Holman ..... A63B 21/4035 482/123
2013/0203567 A1 * 8/2013 Thomas ..... A63B 21/4025 482/124
2014/0057743 A1 * 2/2014 Leggett ..... A63B 69/0002 473/458
2014/0315666 A1 * 10/2014 Medley ..... A63B 21/00043 473/450
2015/0182793 A1 * 7/2015 Gutierrez ..... A63B 21/0442 482/124
2016/0081873 A1 * 3/2016 Sims ..... A61H 15/0092 601/119
2017/0021216 A1 * 1/2017 Gutierrez ..... A63B 21/0552
2018/0200574 A1 * 7/2018 Connolly ..... A61H 15/0092

* cited by examiner

SKILL TRAINING APPARATUS, METHODS OF USE AND MANUFACTURE

CROSS-REFERENCES

This application claims the benefit of U.S. Provisional Application No. 62/524,158, filed Jun. 23, 2017.

BACKGROUND

This technology relates generally to athletic skill development and, more particularly, to methods of maintaining proper foot alignment for certain activities that require agility and consistency.

SUMMARY

In most sports, defensive acuity is integrally linked to a person's footwork. The training of fundamentals is critical in helping an athlete develop proper footwork by developing muscle memory that allows them to naturally and subconsciously position their bodies, including the appropriate posture, for engaging an offensive player in the most efficient manner.

In developing a mechanism that facilitates proper foot alignment, that also can be utilized while engaging in defensive technique simulation, it is preferable to have a device that can securely and reversibly attach to the lower extremities of a user around the ankle region and be designed in such a way that the tarsal region of the foot is protected.

Many training devices currently on the market either have metal rods with unprotected ends (see U.S. Pat. No. 8,961,377) or large blunt ends (see U.S. Pat. No. 8,556,784) that can with repeated use lead to damage to the inner ankle as the ankle repetitively encounters these ends.

There exists a need for a training device that not only allows a user to dynamically transition back-and-forth between a wider and narrower stance, but also protects the lower extremities of the user when in a narrower stance. In particular, during the process of bringing their legs together, the user's foot and ankle could be injured if the training device is not designed in such a way to ergonomically accommodate the ankle and/or have appropriate cushioning features to insulate the foot and/or ankle from full impact against blunt or sharp surfaces.

An additional consideration when evaluating training devices for athletic skill development is the relative cost. Therefore, disclosed herein are methods for the manufacture of a training device in accordance with embodiments of the present invention that allows for the simultaneous production of a plurality of training devices. In the furtherance of this objective, in certain embodiments, modular molds are provided that allow for an unlimited possibility of configurations and expansion capabilities.

When deciding about design choices with respect to a system in accordance with the present invention, providing a system that is made in part with environmentally friendly materials is a preferable design choice that is disclosed herein.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of embodiments in accordance with the present invention are apparent in the following detailed description and claims.

DESCRIPTION OF THE FIGURES

FIG. 7 is an exemplary sectional view of a mold fixture, in an open configuration, in accordance with an embodiment of the present invention.

DETAILED DESCRIPTION

Figure 1:
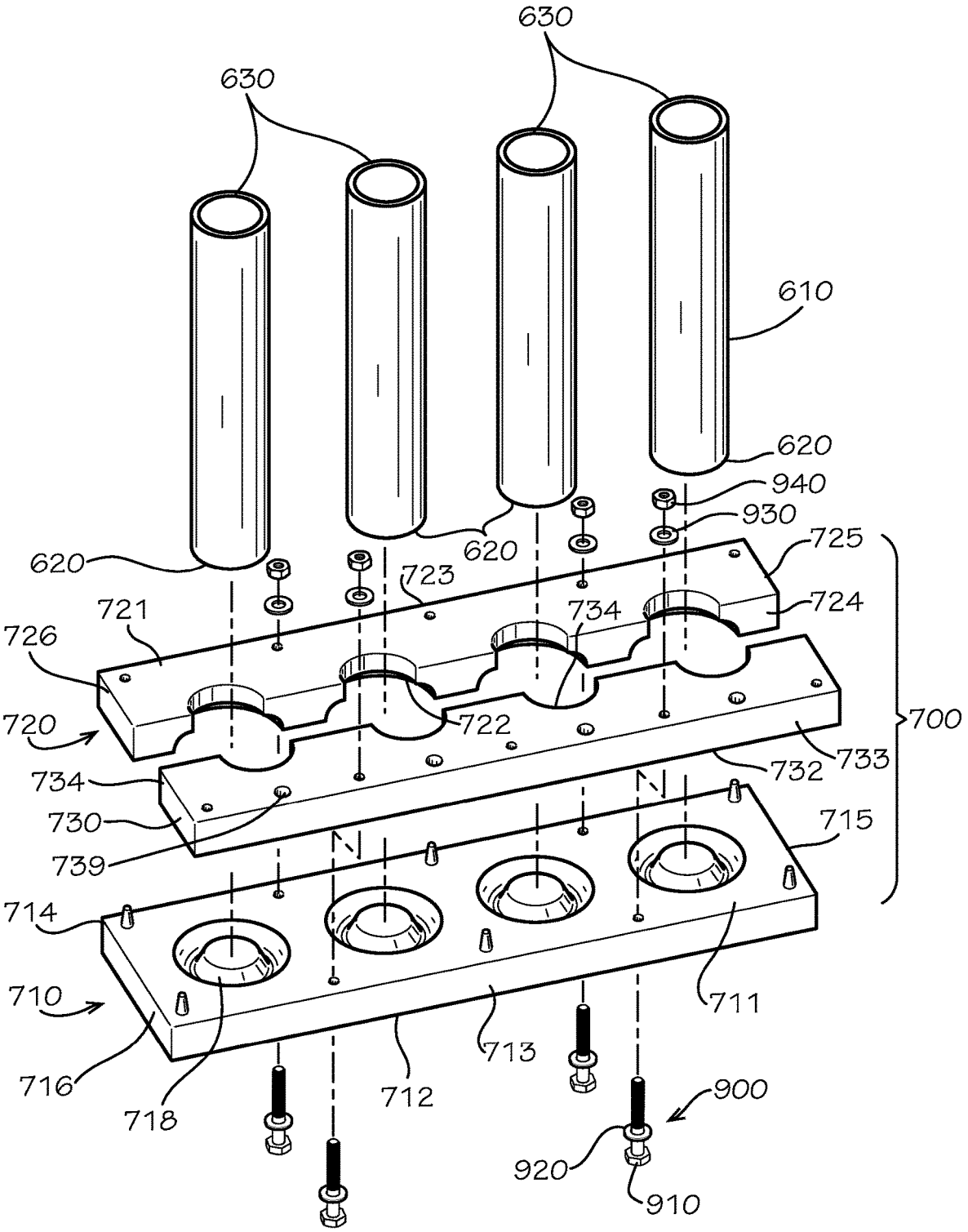
FIG. 1 is an exploded view of an exemplary embodiment of a mold and tubular members used in manufacturing a plurality of skill training apparatus in accordance with the present invention.
Figure 2:
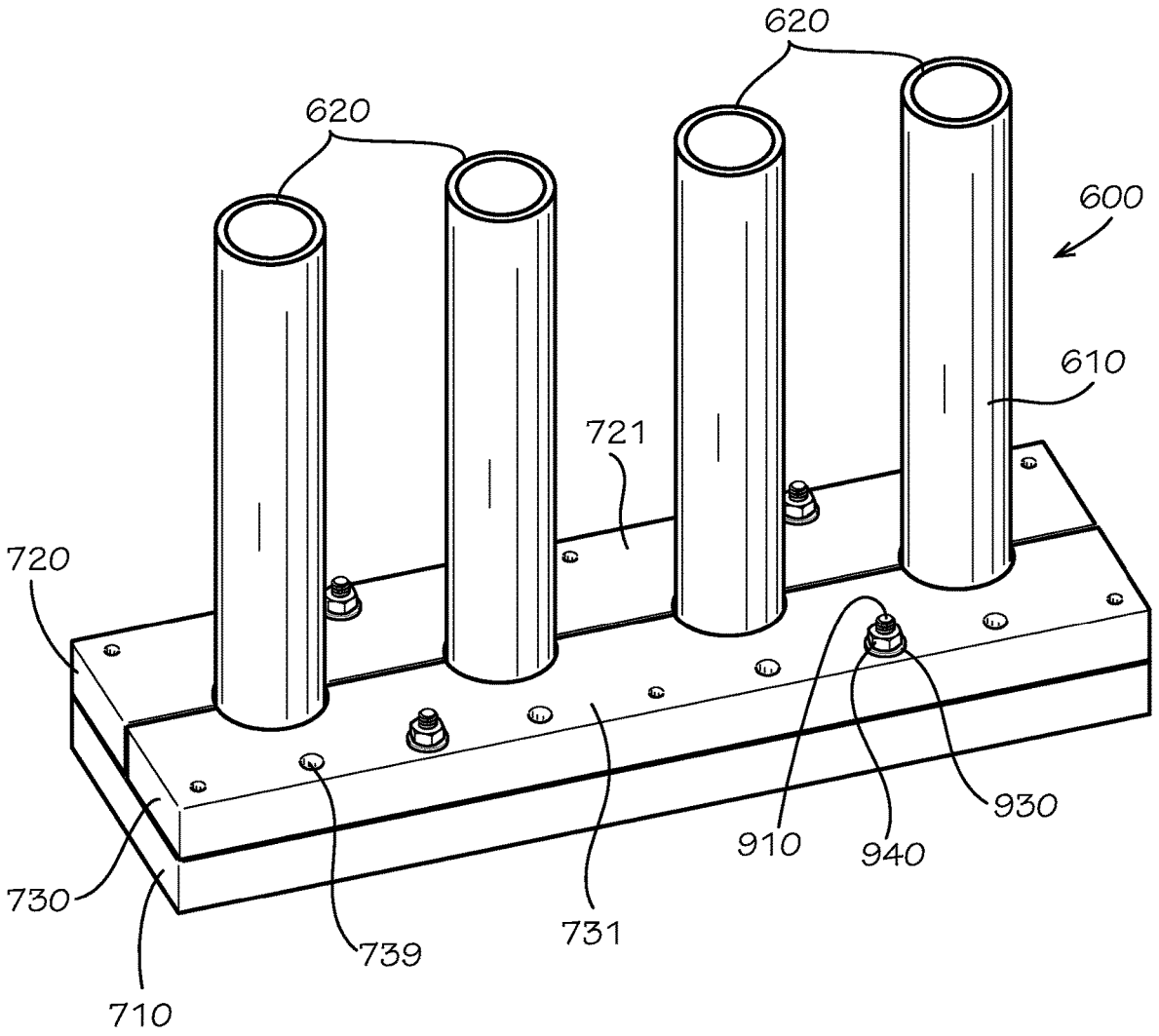
FIG. 2 is a representative isometric view of an exemplary embodiment of a mold and tubular member, in a closed configuration, used in manufacturing a plurality of skill training apparatus in accordance with the present invention.

This technology relates generally to athletic skill development and, more particularly, to methods of maintaining proper foot alignment for certain activities that require agility and consistency.

In developing a mechanism that facilitates proper foot alignment, that also can be utilized while engaging in defensive technique simulation, it is preferable to have a device that can securely and reversibly attach to the lower extremities of a user around the ankle region and be designed in such a way that the tarsal region of the foot is protected.

The tarsal bones are 7 in number. They are named the calcaneus, talus, cuboid, navicular, and the medial, middle, and lateral cuneiforms.

Calcaneus. The calcaneus is the largest of the tarsal bones located in the heel of the foot and bears the weight of the body as the heel hits the ground. This bone protrudes out at the back, providing a strong lever for the triceps surae muscles of the calf and helping with plantar flexion and push off during ambulation (see the image below). The calcaneus is roughly 3-dimensionally rectangular in shape, with its long axis directed anteriorly and laterally, and it has 6 surfaces. In developing fundamentals and reducing the risk of repetitive motion injuries, an athlete needs to develop posture to keep the Calcaneus in proper alignment.

Talus. The talus is the second largest tarsal bone, and it is situated above the calcaneus in the hindfoot. This bone is unique in that two thirds of the talar surface is covered with articular cartilage, and neither tendons nor muscles insert or originate from this bone. The talus has 5 articular surfaces, all of which have a weight-bearing function. The talus is composed of 3 parts (the head, neck, body) and 2 processes (the lateral and posterior), The talar head is the portion that articulates mostly with the navicular. The body includes the dome of the talus at the ankle joint and the posterior facet at the subtalar joint. Between the head and the body is the neck, which does not articulate with the ankle and sits over the sinus tarsi below. The body and neck of the talus are not coaxial, because in the horizontal plane the neck angles medially with a variable angle of declination. The head of the Talus is the protruding part of the foot that most people call the ankle.

Cuboid. The cuboid bone is placed on the lateral side of the foot, in front of the calcaneus, and behind the fourth and fifth metatarsal bones. It is cuboidal in shape but has a broader base oriented medially.

Navicular bone. The navicular bone is located medially in the midfoot between the talus posteriorly and the 3 cuneiform bones anteriorly (see the following image). It forms the uppermost portion of the medial longitudinal arch of the foot and acts as a keystone of the arch. It is a boat-shaped bone that sits between the talar head and the 3 cuneiform bones. The navicular bone has 6 surfaces.

Cuneiforms. The 3 cuneiforms are named the medial, middle, and lateral, and they are convexly shaped on theft broader dorsal surfaces. The middle and the lateral cuneiforms are also wedge shaped, so that the apex of each bone points plantarward and toward the center of the foot. The medial cuneiform is convex medially and rounded inferiorly. The medial and lateral cuneiforms project farther distally that the middle cuneiform to create a mortise for the base of the second metatarsal that articulates with the middle cuneiform. This configuration creates a keystone effect and contributes to the stability of the midfoot.

The ankle joint is composed of the bottom of the tibia (shin) bone and the top of the talus (ankle) bone.

The top of the talus is dome-shaped and is completely covered with cartilage—a tough, rubbery tissue that enables the ankle to move smoothly. A talar dome lesion is an injury to the cartilage and underlying bone of the talus within the ankle joint. It is also called an osteochondral defect (OCD) or osteochondral lesion of the talus (OLT). "Osteo" means bone and "chondral" refers to cartilage. Talar dome lesions are usually caused by an injury, such as an ankle sprain. If the cartilage does not heal properly following the injury, it softens and begins to break off. Sometimes a broken piece of the damaged cartilage and bone will float in the ankle.

The navicular is one of the tarsal bones in the ankle. It sits on top of the calcaneus or heel bone. A stress fracture of the navicular is caused by over use or repetitive strain, usually from high impact sports such as sprinting, hurdling and jumping. A navicular stress fracture is one of the most common stress fractures affecting athletes, especially those in explosive events such as sprinting and jumping. Poor technique or training errors can also contribute to the likelihood of sustaining a stress fracture of the foot. The exact mechanism of injury is not known although it is thought the navicular bone gets pinched or impinged between the bones to the front and back of it causing it to be compressed. If the athlete has a reduced range of dorsi flexion (moving the foot upwards) in the ankle then they are more susceptible to a navicular stress fracture as the midfoot has to compensate for the lack of movement.

Various types of lower extremity injuries such as traumatic ankle ligament injuries (sprained ankle, high ankle sprain), tendinopathiesifasciopathies (achilles tendon rupture, Achilles tendonitis, peroneal tendonitis, plantar fasciitis), bone stress injuries (stress fracture, severs disease, heal spur, shin glints), degenerative conditions (ankle arthritis), soft tissue inflammation (retrocalcaneal bursitis) and biomechanical conditions (anterior ankle impingement, posterior ankle impingement) can be caused or exacerbated by repetitive impact, Therefore, it is important that any system that connects the lower extremities and requires repetitive motion must be configured to protect the structural components of the extremities in order to prevent injury.

Therefore, poor training techniques or even poorly designed training equipment can cause injuries to the foot generally and the talar or navicular regions, in particular. Exemplary embodiments of the system in accordance with the present invention are designed to facilitate proper fundamentals to kinesthetically protect the user but also have design features to protect the tarsal region of the foot.

An exemplary system 10 in accordance with certain embodiments of the present invention can be fabricated through a mass production method that provides consistent quality at a reduced cost.

Specifically referring to the FIGS generally, an embodiment of the system 10 in accordance with the present invention, comprises an elastic device 100 having first and second end portions 110, 120 each terminating with a fastening member 115, 125; first and second bands 200, 300, each capable of being wrapped circumferentially around an extremity 400 of a user 500, each band defining an aperture defining a loop 250, 350 for engagement with the fastening members 115, 125, a hollow tubular member 600 having a middle region 610 extending between first and second end portions 620, 630, the end portions 620, 630, when end portions 620, 630 are molded, having an increased radius 660, 670 with respect to the middle region 610; whereby, when in use, the elastic device 100 extends through the hollow section 650 of the tubular member 600 from one end portion 620 to the other end portion 630 and terminating with bands 200, 300 affixed to the extremities 400 of the user 500 in such a way that the ends of the tubular member 600 rest at a predetermined distance from the band 200, 300. The preferred distance is about between 0.1 millimeters to 75 millimeters and more specifically between 1 millimeter and 25.4 millimeters in the resting state where there is no tension be exerted upon the elastic member 100 by separating the extremities 400 of the user 500. The distance between the band 200, 300 and the tubular member 600 will increase when tension is exerted by elongating the elastic member 100. The further apart the user's extremities, the larger the predetermined distance between the bands and the ends of the tubular members. When making reference to extremities 400, the term is referring to farthest or most remote part, section, or point, a limb of the body; especially a human hand or foot and particular, the lower extremity is a specific reference to the hip, thigh, leg, ankle, or foot. AG. 5 shows an example of the lower extremity of a human.

Figure 6:
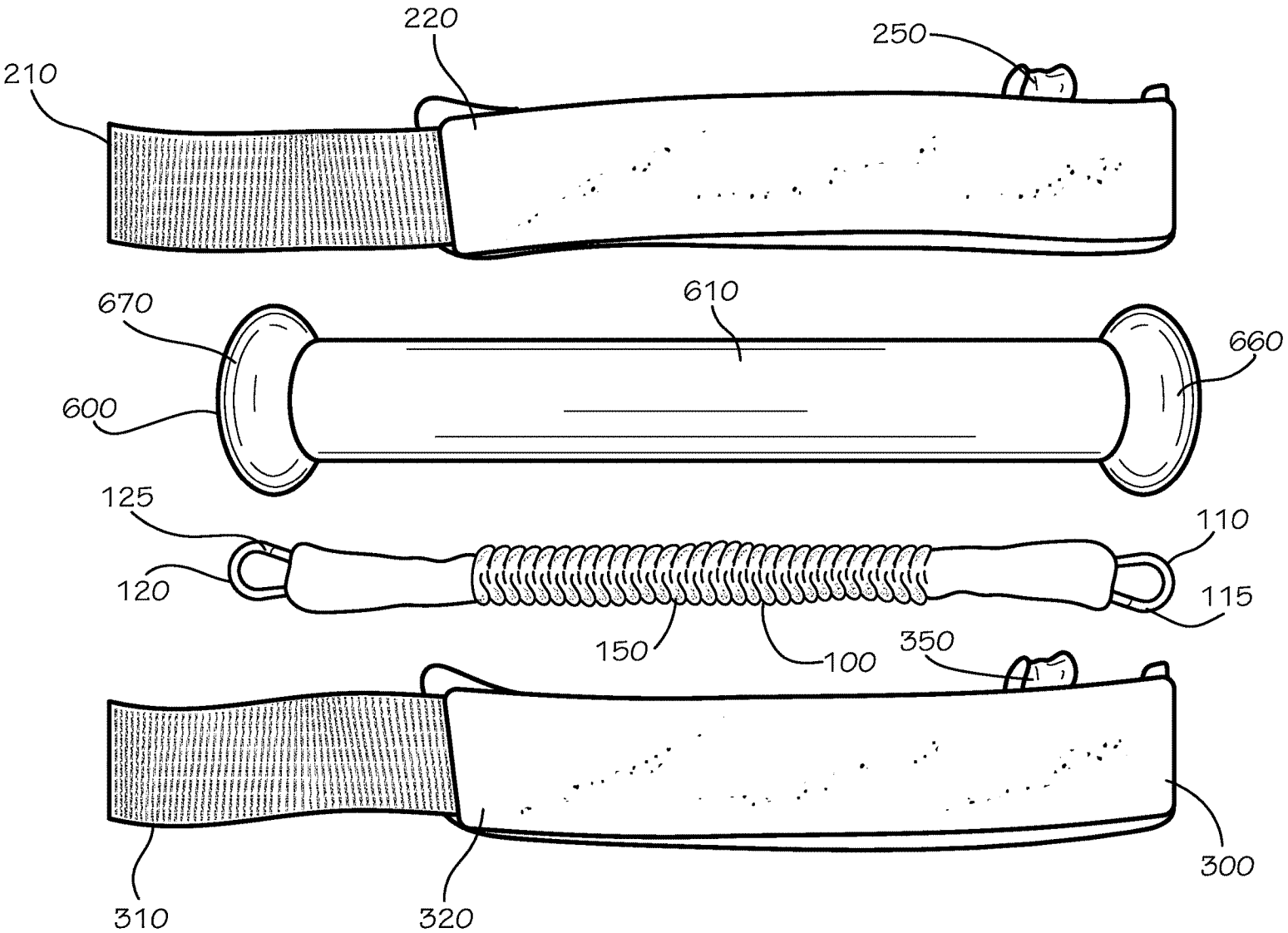
FIG. 6 is an exploded view of exemplary training apparatus in accordance with the present invention.
Figure 7:
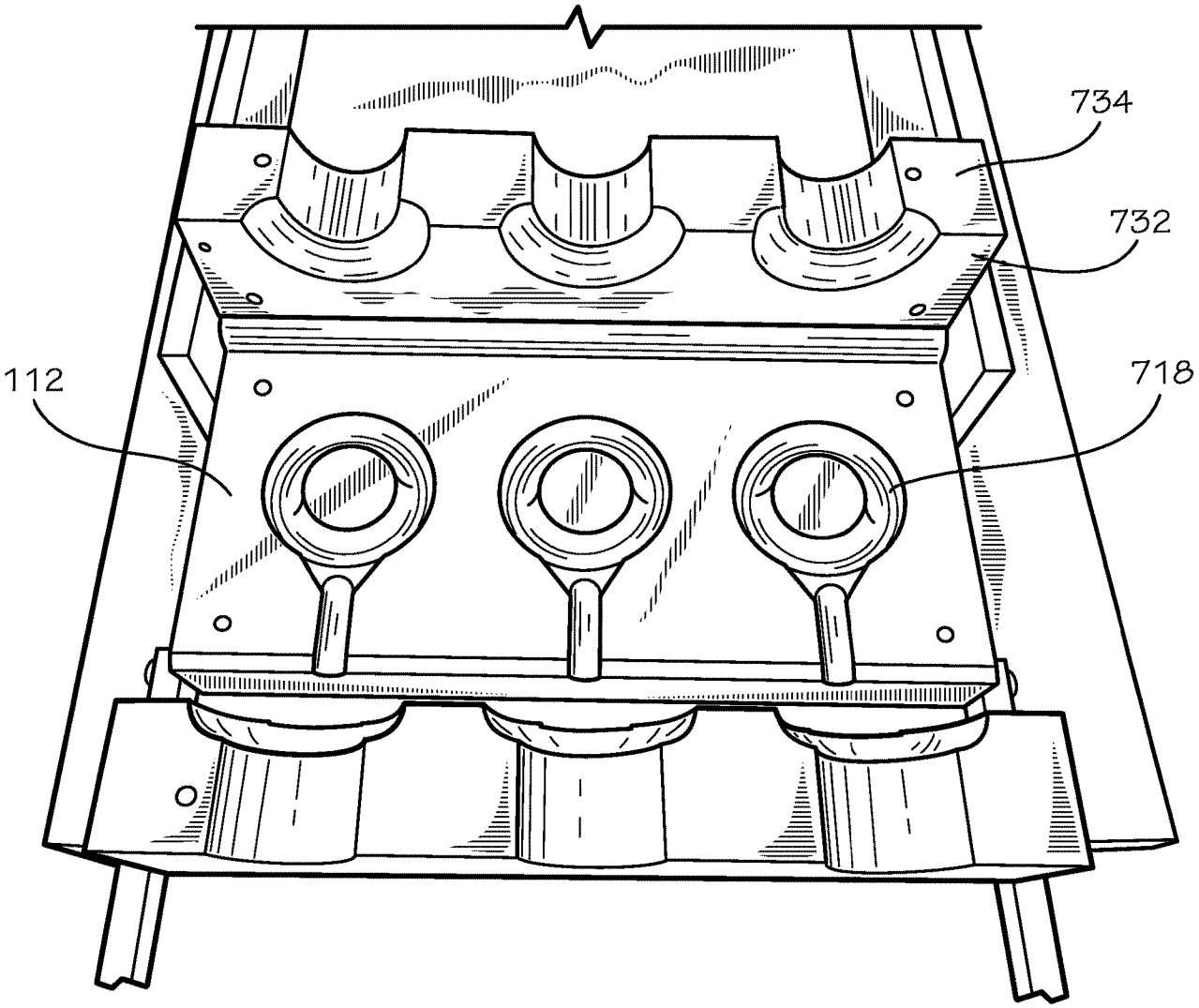
FIG. 7 shows an exemplary training apparatus in accordance with the present invention that is coupled to a region of the lower extremities of a user.

The closure system used in both coupling the bands 200 to the elastic member 100 and coupling the bands 200 around the extremity 400 of a user 500 can be selected from a variety of closure systems in the art such as hook & eye, snap hooks, pin type anchors, swivel hooks, lobster clasps, Kam clips, and hook and loop systems such as Velcro®. Referring to FIG. 6, an exemplary embodiment of a system 10 in accordance with the present invention, with bands 200, 300 shown with a Velcro® fastening member comprising a surface 210, 310 comprising a hook and a surface 220, 320 comprising a loop that when coupled with one another keep the band 200, 300 securely around the lower extremity 400 of a user 500.

Figure 8:
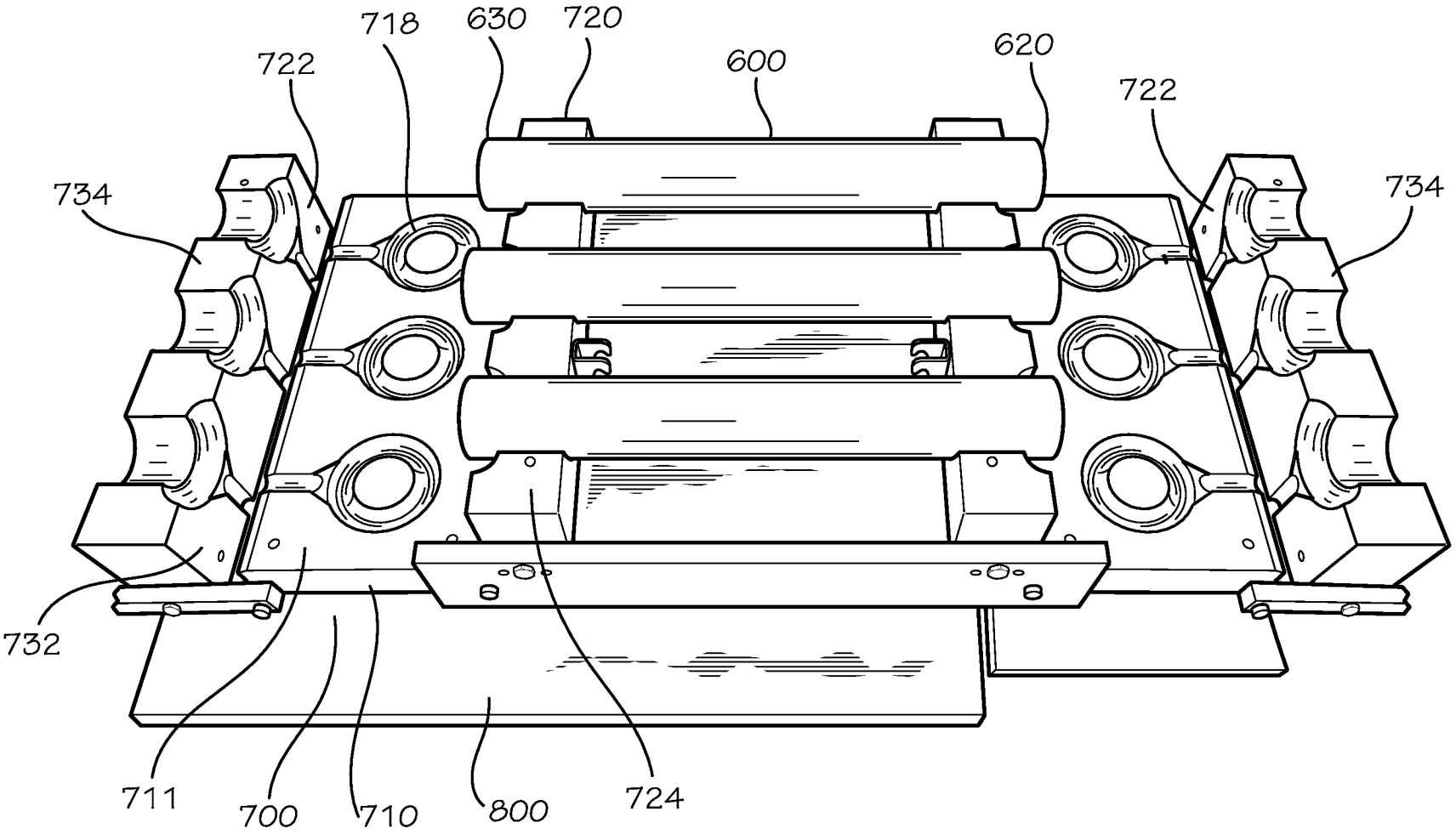
FIG. 8 is an exemplary view of a mold fixture showing the location of the tubular members, in an open configuration, in accordance with an embodiment of the present invention.
Figure 9:
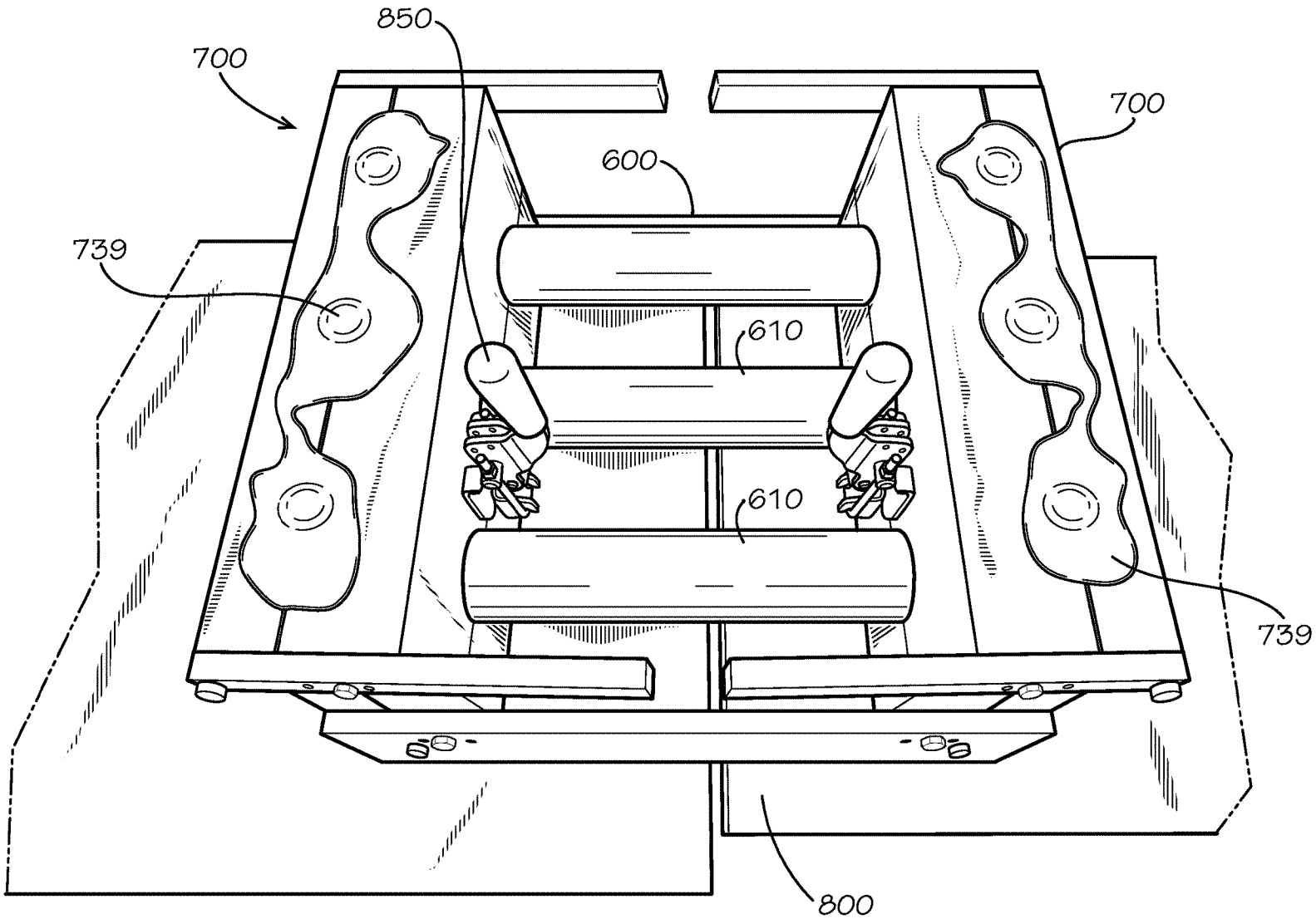
FIG. 9 is an exemplary view of a mold fixture, in a closed configuration, in accordance with an embodiment of the present invention.
Figure 10:
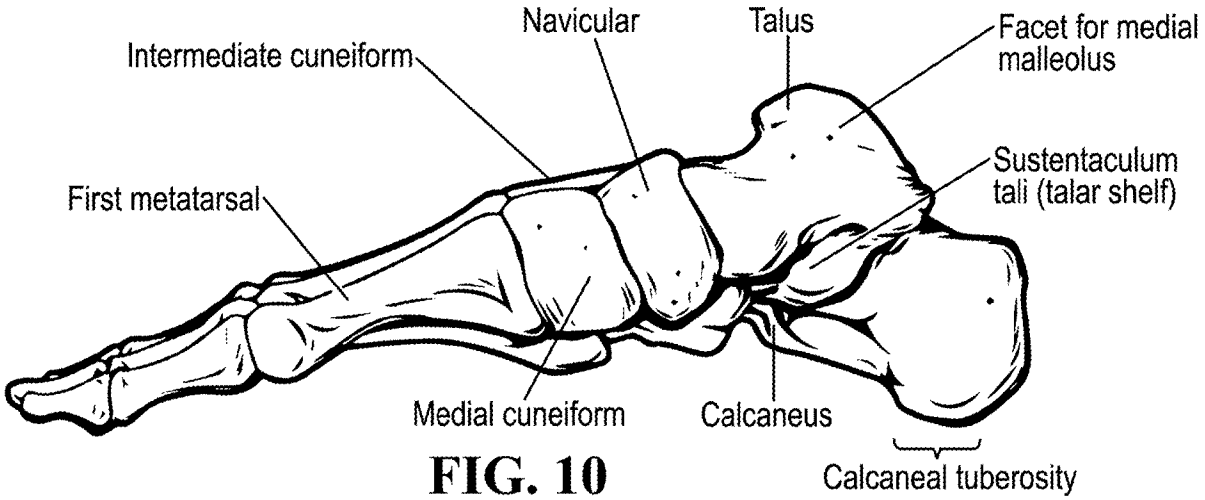
FIG. 10 is an exemplary medial view of the structure of the human foot.
Figure 11:
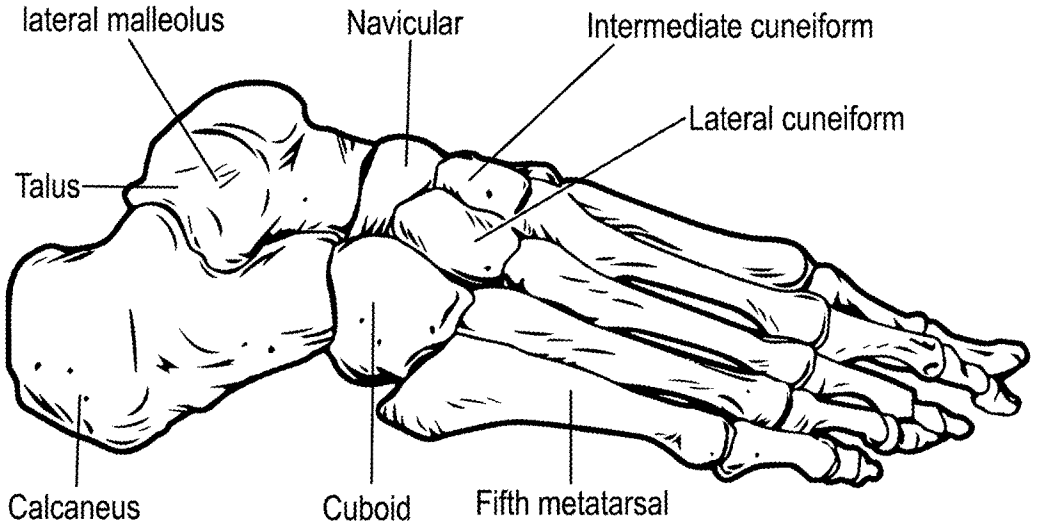
FIG. 11 is an exemplary lateral view of the structure of the human foot.

Referring specifically to FIG. 1, FIG. 8 and FIG. 9, the manufacturing of exemplary systems 10 in accordance with the present invention, comprises providing at least one mold 700 that may consist of several components. As shown in FIG. 1, an exemplary embodiment shows a mold 700 that is comprised of a base 710 and a first and second lid 720, 730 that rests on top of the base 710 in the closed configuration. The base 710 has a reservoir 718 into which the polymer collects when injected through the sprue 739.

The polyurethane can be any variety, including petroleum based polymers or preferably plant based polymers.

Environmentally friendly vegetable oils can be a valuable source of polyols as well as a suitable substitute for isocyanates in the production of polymers. However, the chemistry of some vegetable oils is better suited than others. In order to balance the desired functionality of some vegetable oils with the lower production cost of other vegetable oils; chemical synthesis has been performed on lower cost vegetable oils, with wider commercial availability, to obtain desirable functional groups. This has been performed by methods such as those disclosed in U.S. Pat. No. 7,893,287, which is incorporated in its entirety by this reference.

Exemplary polyols can be selected. a polyol derived from a plant based oil such as a soybean oil, linseed oil, caster oil, etc. Illustrative polyols derived from plant based oils are disclosed in U.S. Pat. Nos. 7,674,925, 7,786,239 and 8,153,746, which are incorporated herein in their entireties by this reference.

Industrially suitable non-isocyanates are carbonates, which can be synthesized from plant-based oils through expoxylation. For example, cyclocarbonate oligomers can be synthesized as follows:

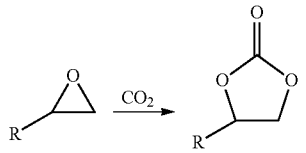

Carbonates may then be used to form hydroxyurethanes by the following method:

Optionally, an additive which could include a colorant (e.g., dyes, pigments, biological pigments, inks, paint, colored chemicals, food colorings and the like or combinations thereof), flame retardant (e.g., Minerals such as; organobromines such as decabromodiphenyl ether (decaBDE), decabromodiphenyl ethane (a replacement for decaBDE), hardener or other desired additive conventional in the art.

It may be appreciated by one of ordinary skill in the art, after being apprised of the present disclosure, that many other ways to prepare plant based carbonates with varying carbonate content. For example, carbonated vegetable oils may be produced in accordance with the teachings of U.S. Pat. No. 7,045,577, which is incorporated herein, in its entirety, by this reference.

In fabricating a system 10 in accordance with preferred embodiments of the present invention, an exemplary method comprises the steps of providing a hollow tube made from metal, polymer or other durable material and cutting it to a predetermined length to form hollow tubular members 600. A mold fabricated to form end regions for the system is provided. A release agent is provided that is applied to the inner surfaces 714, 718, 724, 734 of the mold 700. In preferred embodiments, the release agent is a wax based, non-silicone release agent applied to the interior of the mold 700. The mold 700 is closed and tightened with fixation means (e.g., nuts, bolts, fasteners, latches, tension fit or combinations thereof) 900. Depending on whether there is a single mold 700 or a multiple mold fixture 800, the operator will provide a hollow tubular member 600 into the mold 700 via an aperture in the mold fixture 700. When mass producing systems in accordance with exemplary embodiments of the present invention, multi mold fixtures 800 can be put in an infinite number of configurations. Moreover, the introduction of the tubular member 600 can be automated to increase the number of systems that can be manufactured at a time.

Colorants, flame retardants and/or any other character enhancements may be added to the polymer mixture. A predetermined quantity of polymer is added to the mold 700 via an aperture (sprue) 739 that is preferably located on the top surface 721, 731 of the mold 700. For ease of use a sprue 739 is located on the mold 700 in adjacent to the location where each hollow tubular member 600 is inserted. The polymer is injected via the sprue through various methods such as hand syringing, automated measured injection, or the like.

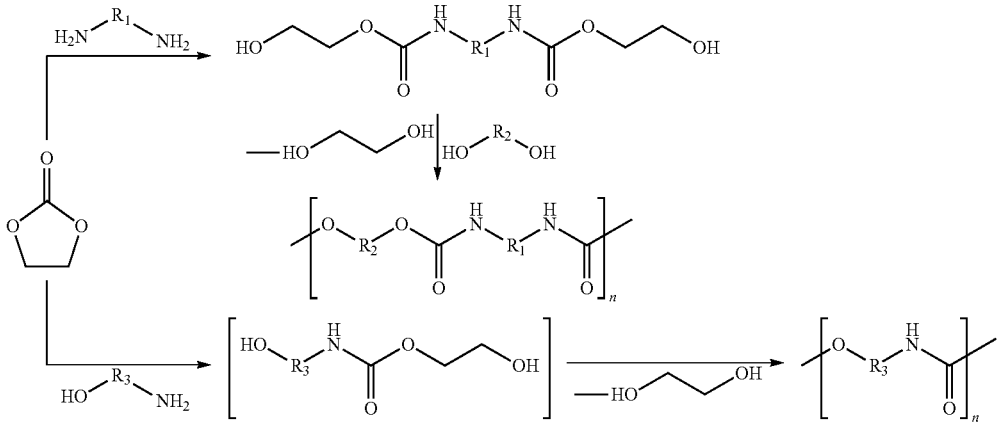

In an exemplary system configured in accordance with embodiments of the present invention, the increased radius 660, 670 is at least in part built up through coupling a polyurethane layer to the end portions 620, 630 of the tubular member 600. Polyurethane (PU) is a leading member of the wide-ranging and highly diverse family of polymers or plastics. Polyurethane can be a solid or can have an open cellular structure, in which case it is called foam and foams can be flexible or rigid. Manufacturers make polyurethane foam by reacting polyols and diisocyanates, both products typically derived from crude oil but may be made from organic sources. A series of additives are necessary to produce high-quality PU foam products, depending on the application the foam will be used for.

Once the polymer has set, approximately about 10-30 minutes, the mold 700 is opened, the hollow tubular members 600 are removed and the mold 700 is cleaned out. The release agent is applied to the interior of the mold 700. Various release agents can be used, an exemplary release agent is Ease Release®, Chemlease® or the like, but the general principal of use will become evident to one of ordinary skill in the art after reviewing the current disclosure. In particular, a method of releasing a polyurethane from a mold is disclosed in U.S. Pat. No. 3,624,190, which is incorporated in its entirety by this reference. In certain embodiments, the hollow tubular members 600 are flipped around and slid in to the mold 700 to make the second end. The process is repeated. Once the second polymer end is set, the hollow tubular member 600 is removed and the polymer ends are cleaned with preferably an abrasive product such as sand paper, primarily at the junction of the polymer and the tubular member 600 opening. In alternative embodiments, as shown in FIG. 8 and FIG. 9, both ends 660, 670 can be molded without having to release and flip the hollow tubular member 600.

After the hollow tubular members are completed indicia may be applied to allow for branding. Depending on the preference of consumers, a resistance band 100 may be threaded through the hollow tubular member 600 and bands or cuffs 200, 300 may be attached at opposite ends 110, 120 of the resistance band 100. An exemplary resistance band 100 can be provided that may be produced in accordance with the teachings of U.S. Pat. No. 5,205,803 or 7,794,374, which each are incorporated herein, in their entireties, by this reference. Exemplary bands or cuffs 200, 300 may be produced in accordance with the teachings of U.S. Pat. No. 3,279,459.

Figure 3:
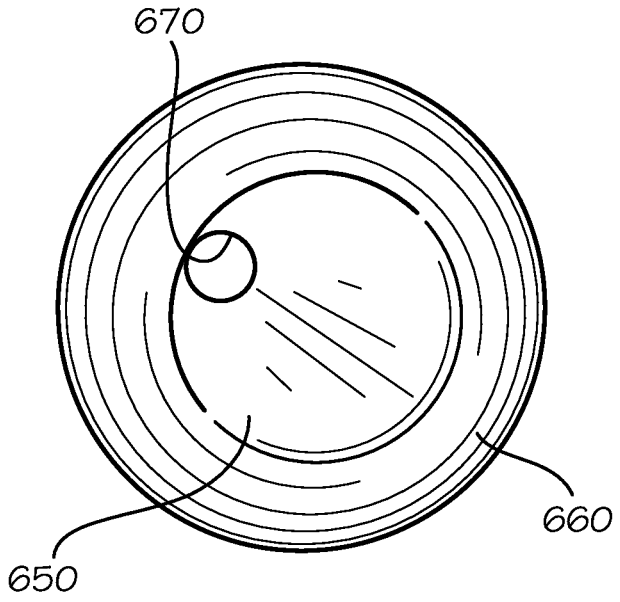
FIG. 3 is an exemplary view of the end region of a tubular member in accordance with an embodiment of the present invention. is an exemplary view of the end region of a tubular member in accordance with an embodiment of the present invention.
Figure 4:
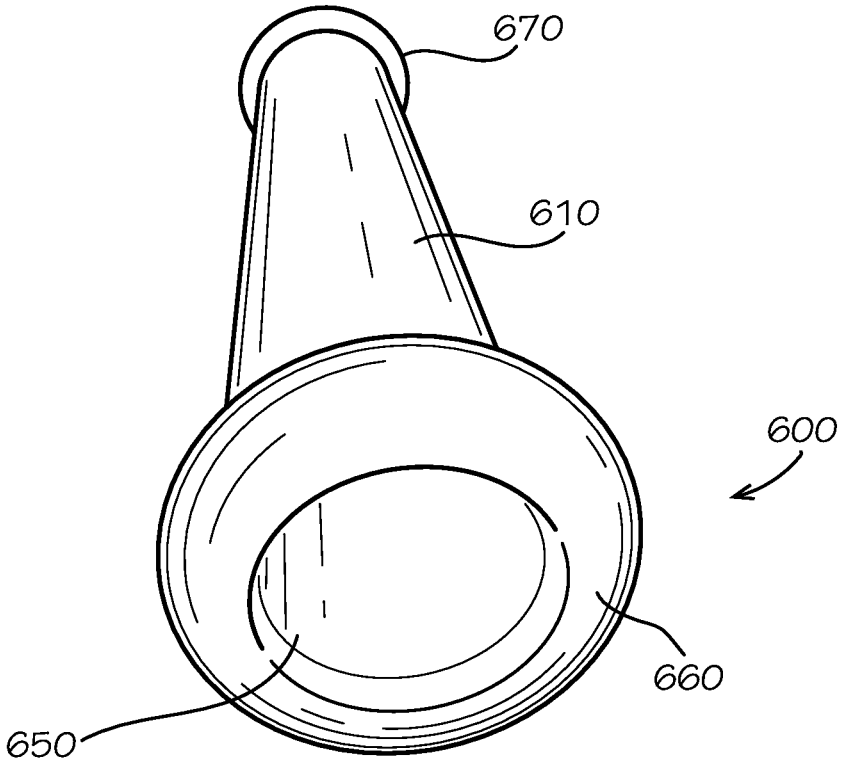
FIG. 4 is an exemplary view of a tubular member in accordance with an embodiment of the present invention.
Figure 5:
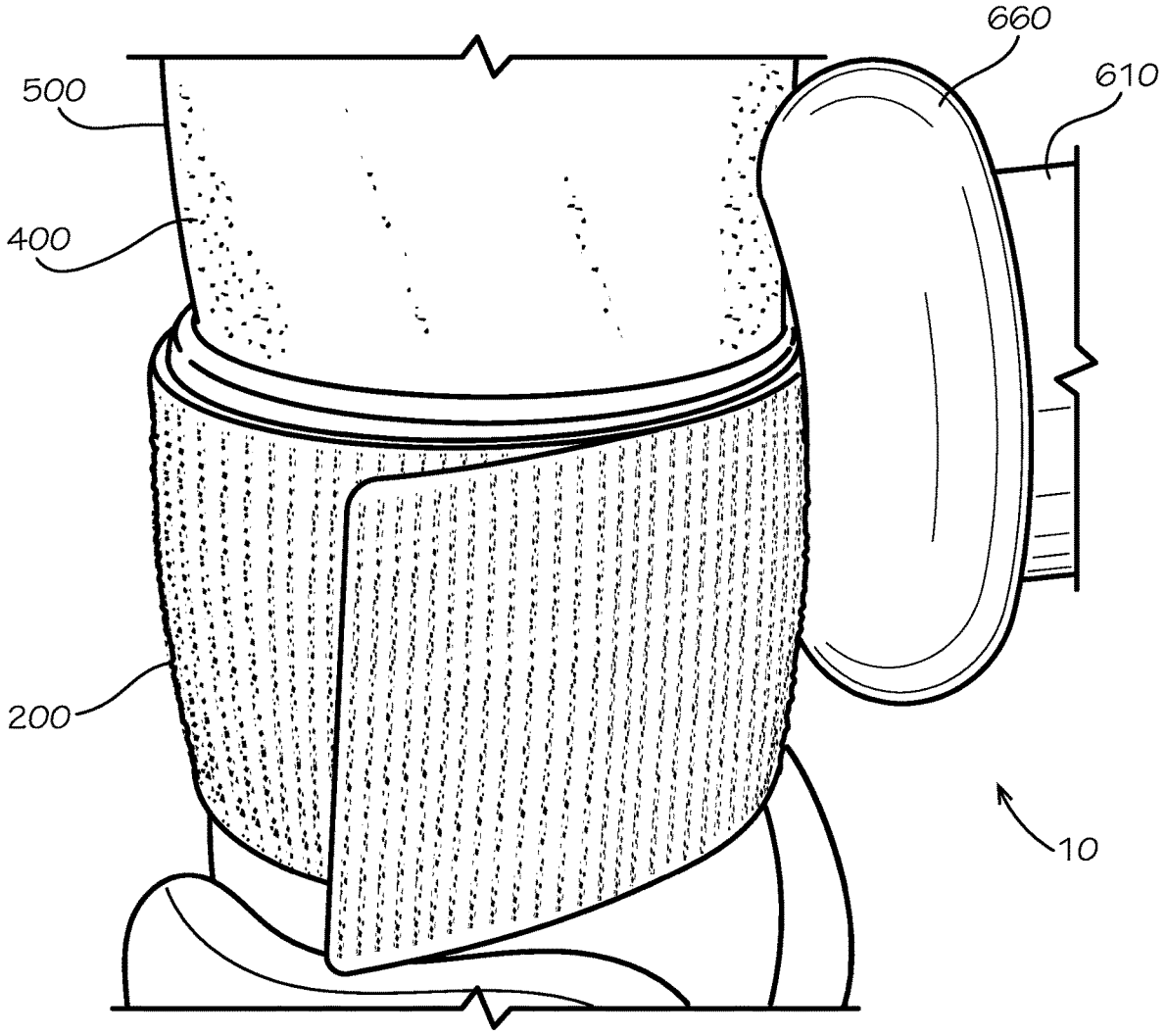
FIG. 5 shows an exemplary training apparatus in accordance with the present invention that is coupled to a region of the lower extremities of a user.

Referring specifically to a means of deploying such a system 10, in one embodiment, a representative system 10 can have the following architecture. Referring to FIG. 3 and FIG. 4, the system 10 comprises a tubular member 600 that is preferably hollow. The tubular member having first and second ends 620, 630 that, when molded, have an increased diameter 660, 670 with respect to the middle section 610 between the ends 620, 630. The increased diameter 660, 670 of the ends 620, 630 facilitates comfort in the event these ends come in contact with the inner ankle of the user 500 as shown in FIG. 5. As disclosed above, the increased diameter 660, 670 is preferably formed by adding a cushioning layer that is preferably formed by coupling a tube with a polyurethane in a mold 700 as shown in FIGS. 1,2 and 7-9.

In preferred embodiments in accordance with the present invention, the middle section 610 of the tubular member extends approximately about 8-16 inches and more preferably 12 inches between increased radius 660 and increased radius 670. Each increased radius is preferably between 0.5-6 inches and more preferably 1 inch in width from the middle section 610 to the end of the tubular member 600. For sake of clarity, the end of tubular member 600 may, but does not necessarily comprise the co-termination of the tubular member ends 620, 630 and the respective increased radius 660, 670. At the terminal ends of the hollow tubular member 600, it is preferable if the inner lumen of the hollow tubular member 600 have an internal diameter of approximately about 0.5-6.0 inches and more preferably 1.5 inches to accommodate protruding portions of a user's 500 extremity 400 such as an ankle.

An exemplary mold 700 can be fastened together via a variety of fastening means known in the art. As shown in FIG. 1, conventional nuts 940, washers 920, 930 and bolts 910 are shown. Alternatively, the mold 700 can be kept in place with tension exerted by clamps 850 that are either part of the overall mold fixture 800 or the mold 700 itself.

Other variations and modifications are possible. The description and illustrations are by way of example only. While the description above makes reference to various embodiments, it should be understood that many changes and modifications can be made without departing from the scope of the disclosure. Many more embodiments and implementations are possible within the scope of this invention and will be apparent to those of ordinary skill in the art. For example, the various embodiments have a wide variety of applications including not just blood banking but could be applicable to medicament administration, food services or other applications were time and temperature are important parameters. It is intended that the appended claims cover such changes and modifications that fall within the spirit, scope and equivalents of the invention. The invention is not to be restricted except in light as necessitated by the accompanying claims and their equivalents. Therefore, the invention is not limited to the specific details, representative embodiments, and illustrated examples in this description.

What is claimed is:

1. An apparatus for use in the training of athletic fundamentals of the user comprising:

an elastic device having first and second end portions each terminating with a fastening member;

first and second bands, having an internal surface and an external surface, the first and second bands each capable of being wrapped circumferentially around an extremity of a user, the first and second bands each having a reversible fastening member to fasten the first and second bands around the extremity of the user, where the internal surface is in contact with the extremity of the user and the external surface having a loop for reversible engagement with the fastening member of the elastic device;

a hollow tubular member having an inner circumference, fixed length middle region extending between a first and a second end, the first and second end of the hollow tubular member having an increased external radius with respect to the middle region, said inner circumference at the first and second ends comprise a hollow section large enough to accommodate a head of the talus region of the user at the first and second ends of the hollow tubular member;

whereby, when in use, the elastic device extends through the hollow section of the tubular member from the first and second end portions of the elastic device and terminating with the first and second bands affixed to the extremities of the user in such a way that the ends of the tubular member rest at a predetermined distance from the band.

2. The apparatus of claim 1, wherein the fastening member of the first and second bands comprises a hook and loop system.

3. The apparatus of claim 2, wherein the hook and loop system is a self-fastener made of nylon.

4. The apparatus of claim 1, wherein the fastening member of the elastic device is one selected from the group comprising hook & eye, snap hooks, pin type anchors, swivel hooks, lobster clasps, Kam clips, or hook and loop systems.

5. The apparatus of claim 4, wherein the fastening member of the elastic device is a hook.

6. The apparatus of claim 1, wherein the distance between the increased radius of the first end and the increased radius of the second end is about 12 inches.

7. The apparatus of claim 1, wherein length of the elastic device is approximately between about 10 inches to 18 inches.

8. The apparatus of claim 7, wherein length of the elastic device is approximately about 13 inches.

9. A method for using a training system, the method comprising the steps of:

providing an apparatus having an elastic device having first and second end portions each terminating with a fastening member; first and second bands, having an internal surface and an external surface, the first and second bands each capable of being wrapped circumferentially around a lower extremity of a user where the internal surface is in contact with the extremity of the user and the external surface having a loop for reversible engagement with the fastening member of the elastic device; and a hollow tubular member having an inner circumference, fixed length middle region extending between a first and a second end, the first and second ends of the hollow tubular member having an increased external radius with respect to the middle region, said inner circumference at the first and second ends comprise a hollow section large enough to accommodate a head of the talus region of the user at the first and second ends of the hollow tubular member;

wrapping the apparatus around a portion of the lower extremities of the user;

whereby, when in use, the elastic device extends through the hollow section of the tubular member from the first and second end portions of the elastic device and terminating with the first and second bands affixed to the extremities of the user in such a way that the ends of the tubular member rest at a predetermined distance from the band.

10. The method of claim 9, wherein the predetermined distance varies depending on the distance between the extremities of the user.

11. The method of claim 10, wherein the further apart the user's extremities, the larger the predetermined distance between the bands and the ends of the tubular members.

* * * * *